US009867748B2

(12) United States Patent
Takeda et al.

(10) Patent No.: US 9,867,748 B2
(45) **Date of Patent: *Jan. 16, 2018**

(54) AIR MATTRESS

(71) Applicant: Paramount Bed Co., Ltd., Tokyo (JP)

(72) Inventors: Kazuhiro Takeda, Tokyo (JP); Shuichi Aoki, Tokyo (JP); Shinji Ueki, Tokyo (JP); Kenta Ohno, Tokyo (JP)

(73) Assignee: PARAMOUNT BED CO., LTD., Tokyo (JP)

( * ) Notice: Subject to any disclaimer, the term of this patent is extended or adjusted under 35 U.S.C. 154(b) by 245 days.

This patent is subject to a terminal disclaimer.

(21) Appl. No.: 14/813,541

(22) Filed: Jul. 30, 2015

(65) Prior Publication Data

US 2016/0008198 A1 Jan. 14, 2016

Related U.S. Application Data

(63) Continuation of application No. 13/519,116, filed as application No. PCT/JP2010/068302 on Oct. 19, 2010, now Pat. No. 9,114,048.

(30) Foreign Application Priority Data

Feb. 5, 2010 (JP) ..... 2010-024853

(51) Int. Cl.
*A61G 7/057* (2006.01)
*A61G 7/05* (2006.01)
(Continued)

(52) U.S. Cl.
CPC ..... *A61G 7/05776* (2013.01); *A61G 7/057* (2013.01); *A61G 7/0527* (2016.11);
(Continued)

(58) Field of Classification Search
CPC .. A61G 7/05776; A61G 7/0527; A61G 7/057; A61G 7/05769; A61G 7/015;
(Continued)

(56) References Cited

U.S. PATENT DOCUMENTS 3,605,138 A 9/1971 Tucker
5,438,721 A 8/1995 Pahno et al.
(Continued)

FOREIGN PATENT DOCUMENTS

WO WO 03/079953 A2 10/2003
WO WO 2009/120270 A2 10/2009

OTHER PUBLICATIONS

Extended European Search Report dated Dec. 14, 2015.
International Search Report in PCT/JP2010/068302 dated Dec. 28, 2010 (English Translation Thereof).

*Primary Examiner* — Robert G Santos
*Assistant Examiner* — Myles A Throop
(74) *Attorney, Agent, or Firm* — McGinn IP Law Group, PLLC.

(57) ABSTRACT

An air mattress include a plurality of air cell groups including a plurality of bladder-shaped cells and lined up with respect to the lengthwise direction of the air mattress so as to support at least a head area, shoulder area, back area, buttock, thigh area, knee area, and heel area of a person lying on the air mattress, an air supply/release pump; and an air tube connecting the bladder-shaped cells and the air supply/release pump in one or a plurality of independent first systems for each of the air cell groups out of the air cell groups and one or a plurality of independent second systems for each of specific bladder-shaped cells out of the plurality of air cell groups. Each of the air cell groups corresponding to the back area, buttock area, and thigh area includes a lower section of bladder-shaped cells and an upper section of bladder-shaped cells.

9 Claims, 8 Drawing Sheets

Replacement Sheet
Serial No.: 14/813,541

(51) Int. Cl.
*A47C 27/10* (2006.01)
*A61G 7/015* (2006.01)
*A61G 7/018* (2006.01)

(52) U.S. Cl.
CPC ..... *A47C 27/10* (2013.01); *A61G 7/015* (2013.01); *A61G 7/018* (2013.01); *A61G 7/05769* (2013.01); *A61G 2203/34* (2013.01); *A61G 2203/44* (2013.01)

(58) Field of Classification Search
CPC ..... A61G 7/018; A61G 2203/44; A61G 2203/34; A47C 27/10
USPC ..... 5/710, 713
See application file for complete search history.

(56) References Cited

U.S. PATENT DOCUMENTS

| | | | | |
|---|---|---|---|---|
| 5,564,142 | A | 10/1996 | Liu | |
| 5,611,096 | A | 3/1997 | Bartlett et al. | |
| 6,009,580 | A * | 1/2000 | Caminade | A61G 7/05769 5/710 |
| 6,014,784 | A | 1/2000 | Taylor et al. | |
| 7,028,358 | B2 * | 4/2006 | Liu | A61G 7/05776 5/710 |
| 7,111,348 | B2 | 9/2006 | Ellis et al. | |
| 9,114,048 | B2 * | 8/2015 | Takeda | A61G 7/05776 |
| 2003/0024051 | A2 | 2/2003 | Wilkinson | |
| 2004/0068801 | A1 | 4/2004 | Wilkinson | |
| 2010/0205750 | A1 * | 8/2010 | McCausland | A47C 27/082 5/713 |
| 2010/0318239 | A1 * | 12/2010 | Oexman | A47C 23/0433 700/301 |

* cited by examiner

Replacement Sheet
Serial No.: 14/813,541

AIR MATTRESS

The present application is a Continuation Application of U.S. patent application Ser. No. 13/519,116, filed on Aug. 1, 2012, which is based on International Application No. PCT/JP2010/068302, filed on Oct. 19, 2010, which is based on the Japanese Patent Application No. 2010-024853, filed on Feb. 5, 2010, the entire contents of which are incorporated herein by reference.

TECHNICAL FIELD

The present invention relates to an air mattress, and in particular to an air mattress capable of preventing the occurrence of decubitus ulcers in a person lying on the air mattress.

BACKGROUND ART

Conventionally, an air mattress for preventing decubitus ulcers such as that disclosed in patent document 1 and 2 is known. Patent document 1 discloses an air mattress formed by a plurality of bladder-shaped air cells disposed upon a base sheet, wherein all of the air cells are divided into an upper layer and a lower layer by a divider, and all of the air cells are respectively inflated or deflated in the upper layers and lower layers thereof.

Patent document 2 discloses a technique of providing a plurality of air cells within the interior of a retaining member formed from an elastic material so as to line up in the lengthwise direction of the air mattress and adjusting the pressure within the air cells, thereby preventing decubitus ulcers.

Patent document 3 discloses a technique of preventing repelling force from being placed by a mattress upon a location of a person lying on the air mattress at which decubitus ulcers have occurred, and discloses lining up multiple cuboid air cells in the lengthwise direction and widthwise direction of an air mattress, attaching a magnetic marker to a location of a person at which decubitus ulcers have occurred, detecting the position of the marker by means of a magnetic sensor provided in each of the air cells, and reducing the pressure in the air cells corresponding to the position of the detected marker.

PRIOR ART LITERATURE

Patent Literature

Patent Document 1: Registered Japanese Utility Model No. 3115039

Patent document 2: Unexamined Japanese Patent Application Publication No. 2000-189288

Patent document 3: Unexamined Japanese Patent Application Publication No. 2007-144007

DISCLOSURE OF THE INVENTION

Problems the Invention is Intended to Solve

However, the following problems are present in the above described prior art. The air mattress according to patent document 1 is configured so that all of the air cells are inflated and deflated in upper layers and lower layers thereof. As such, the repelling force placed by the mattress upon the buttock area of the person lying on the air mattress is great, and the occurrence of decubitus ulcers cannot be completely prevented.

The air mattress according to patent document 2 is configured so that the pressure inside all of the air cells is identical. As such, as in the case of patent document 1, the repelling force placed by the mattress upon the buttock area of the person lying on the air mattress is great, and the occurrence of decubitus ulcers cannot be completely prevented.

The technique according to patent document 3 is for preventing repelling force from being placed by the mattress upon a specific location at which decubitus ulcers have occurred, and is not for preventing the occurrence of decubitus ulcers.

An object of the present invention is to provide an air mattress capable of preventing the occurrence of decubitus ulcers in a person lying on the air mattress.

Means for Solving the Problems

The air mattress according to the present invention has a plurality of air cell groups made from a plurality of air cells and lined up with respect to the lengthwise direction of the air mattress so as to support at least a shoulder area, a back area, a buttock area, a thigh area, and a knee area of a person lying on said air mattress; an air supply/release pump; an air tube connecting said air cells and said air supply/release pump in one or a plurality of independent first systems for each of certain air cell groups out of said air cell groups and one or a plurality of independent second systems for each of specific air cells out of a remainder of certain air cell groups out of the plurality of air cell groups; and a controller for controlling air supply/release by the air supply/release pump to said first systems and second systems; wherein: each of the air cell groups corresponding to said back area, buttock area, and thigh area has a lower section of air cells and an upper section of air cells; the lower section air cells are connected to said first system via said air tube; and each of the air cells in each of the air cell groups corresponding to said shoulder area, knee area, as well as the upper section of the back area, buttock area, and thigh area, are connected to one system out of the plurality of said second systems via said air tube.

In the air mattress according to the present invention, the controller performs a control so that, for instance, the pressure in the air cell groups corresponding to the head area and heel area of the person lying on the air mattress is maintained at a fixed level. Alternatively, the controller controls pressure so that, for instance, the pressure in the air cell groups corresponding to the head area of the person lying on the air mattress is maintained at a fixed level, and the air cell groups corresponding to the heel area are repeatedly inflated and deflated.

In the air mattress described above, the air cells of the air cell groups are, for example, rod-shaped and bladder-shaped cells extending in the widthwise direction of the air mattress, and the air cells are configured so as to be lined up in the lengthwise direction of the air mattress.

Each of the air cell groups corresponding to, for example, the back area, buttock area, and thigh area has a lower section of air cells and an upper section of air cells; the lower section air cells are connected to the first system via the air tube; the pressure of the air cell groups corresponding to the back area and thigh area is maintained at a fixed level greater than the pressure in the air cell groups corresponding to the buttock area; each of the air cells in each of the air cell groups corresponding to the shoulder area, knee area, as well as the upper section of the back area, buttock area, and thigh area, are connected to one system out of the plurality of the second systems via the air tube; and each of the air cell groups is controlled so as to repeatedly inflate and deflate in order for each of the systems.

Another air mattress according to the present has a plurality of air cell groups made from a plurality of air cells and lined up with respect to the lengthwise direction of the air mattress so as to support at least a shoulder area, a back area, a buttock area, a thigh area, and a knee area of a person lying on said air mattress; an air supply/release pump; an air tube connecting said air cells and said air supply/release pump in a plurality of independent systems for each of the air cell groups; and a controller for controlling air supply/release by said air supply/release pump to said plurality of systems; wherein each of the air cell groups corresponding to said back area, said buttock area, and said thigh area includes a lower section of air cells and an upper section of air cells which are independent to each other and are controlled independently, wherein the lower section air cells are connected to a system of the plurality of independent systems via said air tube, and wherein each of the air cells in each of the air cell groups corresponding to said shoulder area and said knee area, and said each of the upper sections of the air cells in each of the air cell groups corresponding to said back area, said buttock area, and said thigh area is connected to another system of the plurality of independent systems via said air tube.

Effects of the Invention

In the air mattress according to the present invention, the controller performs a control so that the pressure in the air cell groups corresponding to the back area and thigh area is greater than the pressure in the air cell groups corresponding to the buttock area. It is thereby possible to stably support the buttock area of a person from both sides thereof using the air cell groups for the back area and the thigh area, and to disperse body pressure. It is thus possible to prevent the repelling force placed upon the buttock area of the person on the air mattress by the air mattress from growing large and decubitus ulcers from occurring.

BEST MODE FOR CARRYING OUT THE INVENTION

Figure 1:
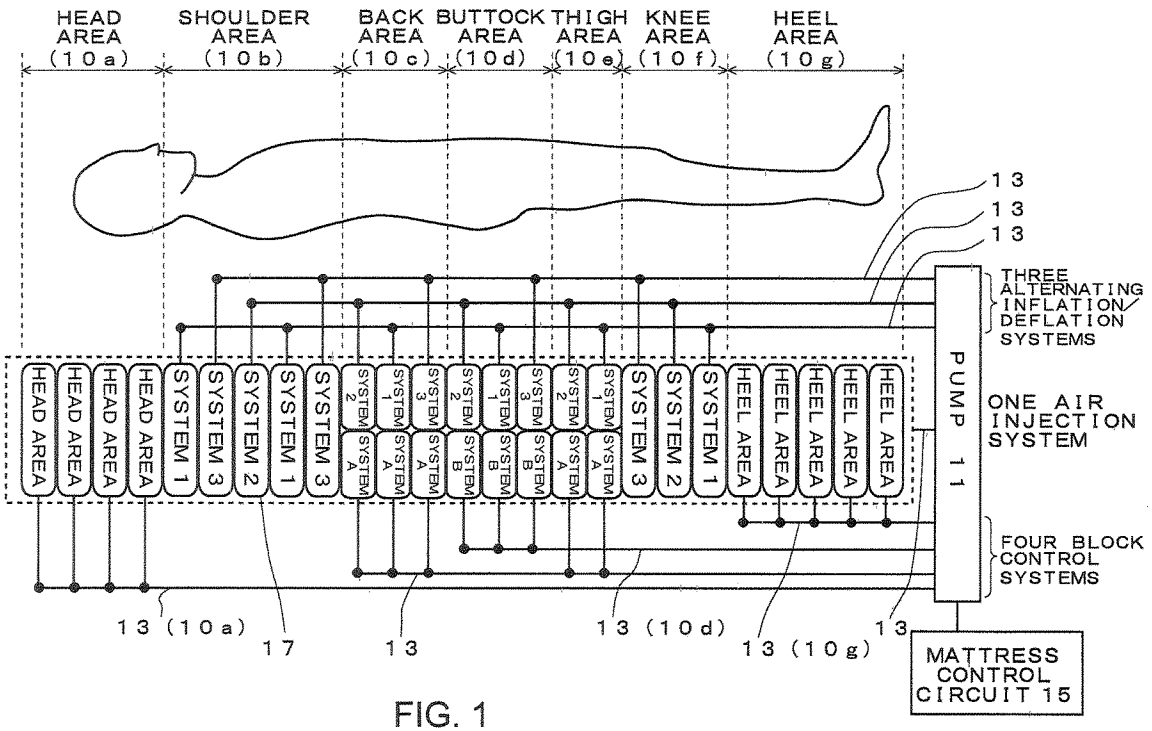
FIG. 1 is a schematic view of air supply/release systems for each of the bladder-shaped cells of an air mattress according to an embodiment of the present invention.
Figure 2:
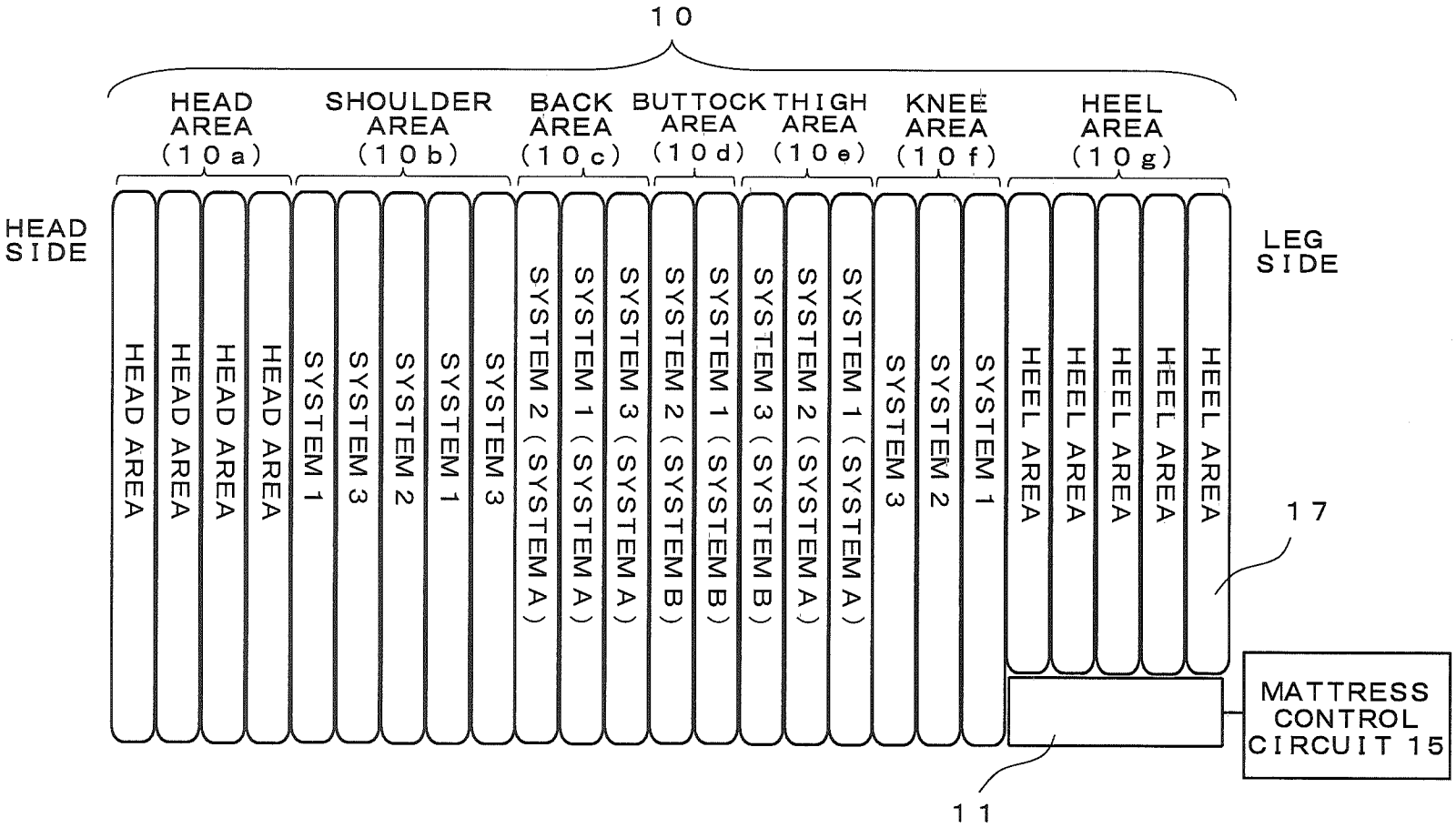
FIG. 2 is a plan view of the disposition of each of the bladder-shaped cells and the air supply/release pump of an air mattress according to an embodiment of the present invention.
Figure 3:
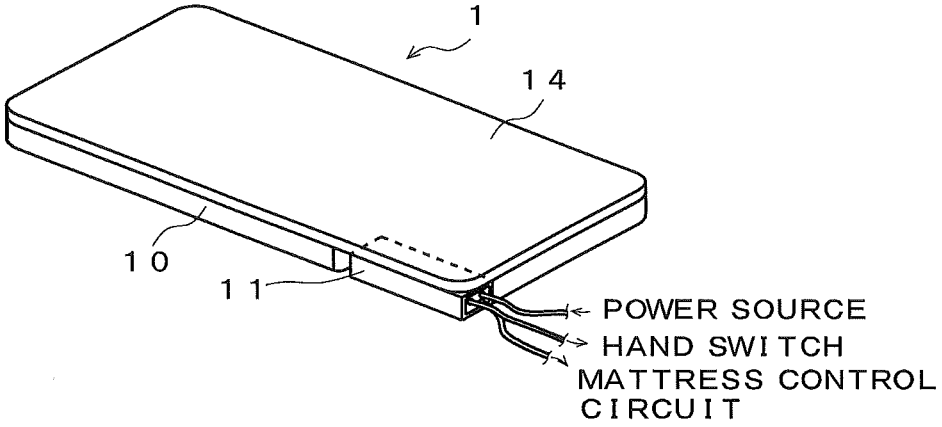
FIG. 3 is a perspective view of an air mattress according to an embodiment of the present invention.
Figure 4:
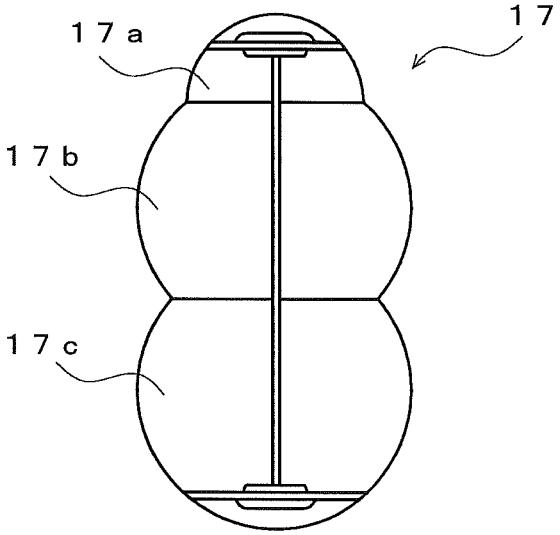
FIG. 4 is an illustration of one example of a bladder-shaped cell corresponding to the back area, the buttock area, and the thigh area in an air mattress according to the embodiment of the present invention.
Figure 5:
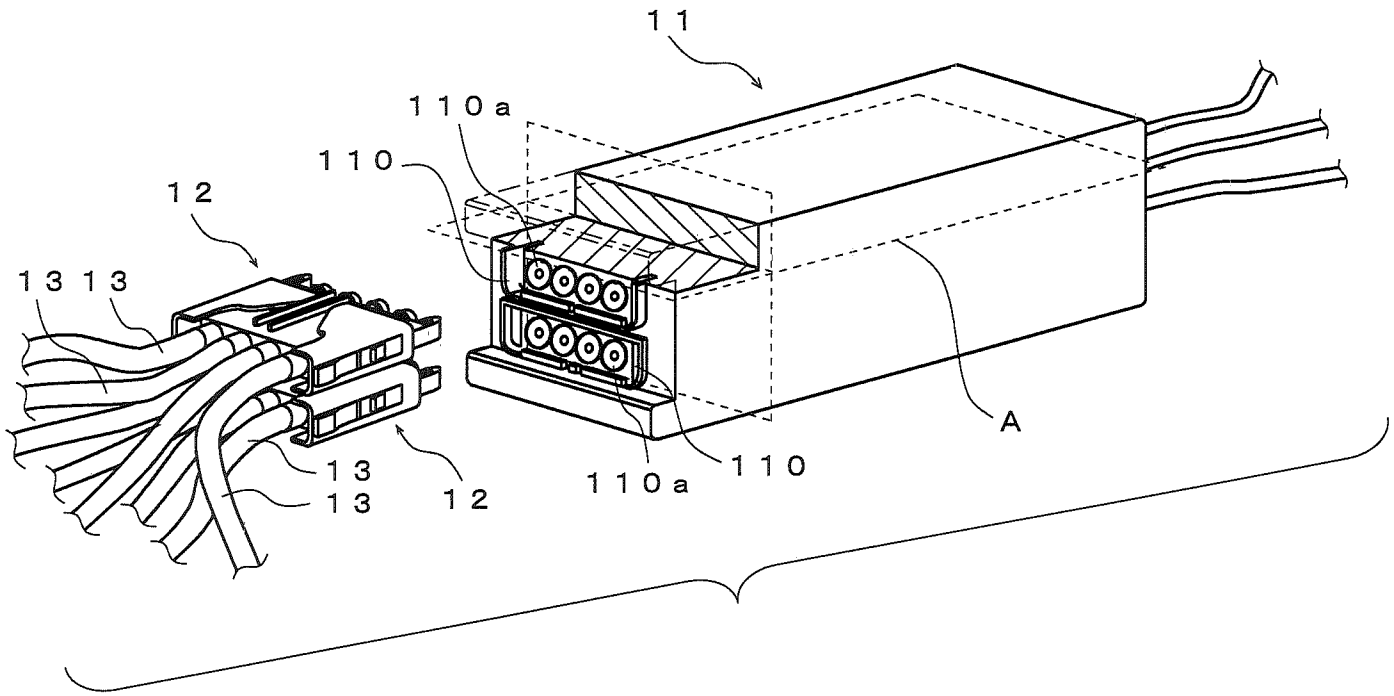
FIG. 5 is a perspective view of an air supply/release pump and a connector of an air mattress according to an embodiment of the present invention.
Figure 6:
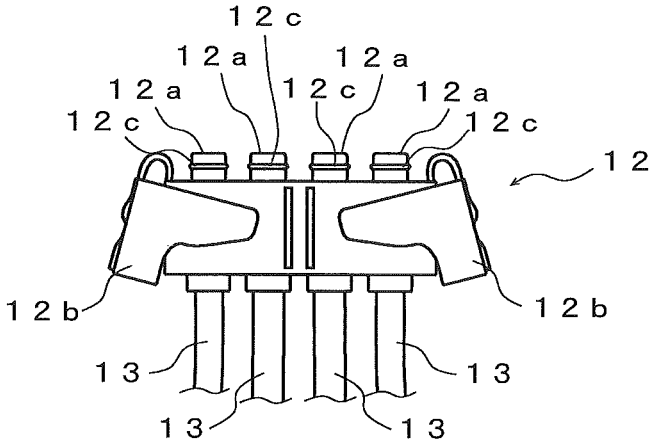
FIG. 6 is a plan view of an air tube-side connector of an air mattress according to an embodiment of the present invention.

Hereafter follows a detailed description of an air mattress according to an embodiment of the present invention with reference to the attached drawings. FIG. 1 is a schematic view of an air supply/release system to each of the bladder-shaped cells in an air mattress according to an embodiment of the present invention, FIG. 2 is a perspective view of an air mattress according to an embodiment of the present invention, FIG. 3 is a plan view of the disposition of each of the bladder-shaped cells and the air supply/release pump of an air mattress according to an embodiment of the present invention, and FIG. 4 is a schematic view of air supply/release systems for bladder-shaped cells corresponding to a back area, a buttock area, and a thigh area in an air mattress according to an embodiment of the present invention. FIG. 5 is a perspective view of an air supply/release pump and a connector of the present embodiment, FIG. 6 is a plan view of an air tube-side connector of the present embodiment, FIGS. 7(*a*) and 7(*b*) are views of an air tube-side connector of the present embodiment from a mating surface side thereof, and FIGS. 8(*a*), 8(*b*), and 8(*c*) are cross-sectional views of cross-section A of FIG. 5, illustrating a process of removing a connector of an air mattress according to the present embodiment.

First, the configuration of the air mattress according to the present embodiment will be described. As shown in FIGS. 1 through 3, the air mattress 1 according to the present embodiment is provided with a plurality of air cell groups 10, each of which groups comprising a plurality of bladder-shaped cells 17, an air supply/release pump 11, an air tube 13 connecting the bladder-shaped cells 17 of each of the air cell groups 10 to the air supply/release pump 11, and a mattress control circuit 15 for controlling air supply/release to each of the air cell groups 10 by the air supply/release pump. In the present embodiment, as shown in FIG. 3, the plurality of air cell groups 10, the air tube 13, and air supply/release pump 11 constitute an integrated whole.

As shown in FIG. 2, each of the bladder-shaped cells 17 of the plurality of air cell groups 10 is a rod-shaped cell extending in, for example, the widthwise direction of the air mattress 1, and the plurality of bladder-shaped cell 17 is lined up in the lengthwise direction of the air mattress to constitute the main body of the air mattress. As shown in FIG. 1 and FIG. 2, the plurality of bladder-shaped cells 17 is disposed lined up with respect to the lengthwise direction of the air mattress 1 so that a plurality thereof corresponds to each of the head area, shoulder area, buttock area, thigh area, knee area, and heel area of a person lying on the air mattress 1, and constitute air cell groups 10*a* through 10*e* corresponding to each of the locations of the body of the person. In the present embodiment, as shown in FIG. 1, the bladder-shaped cells 17 corresponding to the back area, buttock area, and thigh area of a person are divided into upper sections and lower sections, and the air pressure for each is controlled by different systems. each of the bladder-shaped cells 17 is, for example, formed by stitching together resin material such as nylon fibers or the like, and bladder-shaped cells 17 disposed adjacent to one another are fixed together by, for example, being stitched together. The fixing of adjacent bladder-shaped cells 17 may also be performing using, for example, an adhesive. In this way, the air mattress 1 supports the body of a person lying on the mattress by having the plurality of rod-shaped cells extending in the widthwise direction of the air mattress 1 being lined up in the lengthwise direction of the air mattress, and the interior of each of the bladder-shaped cells 17 being filled with air. By adjusting the air pressure within the bladder-shaped cells 17 according to each of the locations of the body, it is possible, for example, to cause the pressure within the bladder-shaped cells for the back area and the thigh area to be greater than that of the pressure within the bladder-shaped cells for the buttock area, thus enabling dispersion of body pressure. each of the plurality of bladder-shaped cells 17 is provided at at least one location with an air supply/release terminal for connecting to the air tube 13. In the present embodiment, an air supply/release terminal at one location each, and each of the bladder-shaped cells is configured so as to be capable of being inflated and deflated by connecting the air tube 13 to the air supply/release terminal and supplying air to or releasing air from the bladder-shaped cell via the air tube 13 of each of the systems. The air tube 13 used is preferably, for example, manufactured from a resin such as vinyl chloride.

each of the bladder-shaped cells 17 of air cell groups 10*c* through 10*e* corresponding to the back area, buttock area, and thigh area of the person on the mattress are divided into, as shown for example in FIG. 4, upper bladder-shaped cells and lower bladder-shaped cells 17*c*, and the upper bladder-shaped cells and lower bladder-shaped cells 17*c* are fixed together using, for example, an adhesive. Furthermore, a divider member of, for example, nylon fibers or the like is further provided within the upper bladder-shaped cells, which are divided into an upper section of bladder-shaped cells 17*a* and a middle section of bladder-shaped cells 17*b*. The divider member is disposed, for example, at parts other than the two ends of the boundary between the upper section bladder-shaped cells 17*a* and the middle section bladder-shaped cells 17*b*, and the upper section bladder-shaped cells 17*a* and the middle section bladder-shaped cells 17*b* are connected at the two ends with respect to the lengthwise direction of the bladder-shaped cells. A configuration is thus formed in which it is possible to control pressure so that the pressure in the interior of the upper section bladder-shaped cells 17*a* and the pressure in the interior of the middle section bladder-shaped cells 17*b* becomes equal. By configuring the bladder-shaped cells 17 in this way so as to have three sections of upper section and middle section bladder-shaped cells 17*a*, 17*b* on an upper side and lower bladder-shaped cells 17*c*, it is possible, for example, to set the pressure in the lower section bladder-shaped cells 17*c* higher than the pressure in the upper bladder-shaped cells 17*a*, 17*b* so that, while the pressure within the upper section bladder-shaped cells 17*a* is equal to the pressure within the middle section bladder-shaped cells 17*b*, the surface tension in the surfaces of the upper section bladder-shaped cells 17*a*, whose sides have a small radius of curvature, is smaller than the surface tension in the middle section bladder-shaped cells 17*b*, yielding a soft feel. The three-sectioned bladder-shaped cells 17 are thus configured so that feel against the skin is softened by the upper sections bladder-shaped cells 17*a*, repelling force against the human body is softened by the middle section bladder-shaped cells 17*b*, and the human body is stably supportable by the lower section air cells 17*c*.

In the present embodiment, as shown in FIG. 1, the plurality of bladder-shaped cells 17 in an air cell group 10*a*, which corresponds to the head area of a person lying on the air mattress, is connected to a common air tube 13 so that air is supplied or released through an independent air supply/release system, and the plurality of bladder-shaped cells in an air cell group 13*g*, which corresponds to the heel area, is connected to a common air tube 13 so that air is supplied or released through a single independent air supply/release system. Furthermore, out of the bladder-shaped cells 17 of an air cell group 10*c* corresponding to the back area of a person lying on the air mattress, the bladder-shaped cells in a lower section are connected to an air tube 13 shared with the bladder-shaped cells in a lower section of an air cell group 10*e* corresponding to the thigh area, and are configured so that air is supplied or released through a single independent air supply/release system (system A). Likewise, the bladder-shaped cells in a lower section of an air cell group 10*d* corresponding to the buttock area is connected to a common air tube 13 so that air is supplied or released through a single independent air supply/release system (system B). In the present embodiment, the plurality of bladder-shaped cells 17 of an air cell group 10*b* corresponding to the shoulder area of a person lying on the air mattress is connected to one of three independent air supply/release systems (system 1, system 2, and system 3) via an air tube 13, and is configured so that independent air supply or release is performed for each of the systems. Likewise, the pluralities of bladder-shaped cells of air cell groups 10*c* through 10*f* corresponding to the back area (upper section), buttock area (upper section), thigh area (upper section), and knee area are connected to one of three independent air supply/release systems (system 1, system 2, and system 3) via an air tube 13, and are configured so that independent air supply or release is performed for each of the systems. As shown in FIG. 1 and FIG. 2, the bladder-shaped cells 17 connected to each of the three air supply/release systems are disposed in alternation in the order system 1, system 3, system 2, system 1, system 3 . . . from the shoulder area to the knee area. Each of the bladder-shaped cells in the same air supply system (system 1, system 2, or system 3) is connected to a common air tube 13. In the present embodiment, an air injection tube 13 for supplying air to one independent system is laid on a lower surface of the mattress, and is configured so that, by supplying air to the air injection tube, air is ejected from a plurality of injection holes provided on an outer surface of the air injection tube, enabling moisture to be removed from the mattress. Specifically, the present embodiment is provided with four block control air supply/release systems for supplying air to individual independent systems of air cell groups 10 corresponding to the head area, heel area, buttock area (lower section), as well as the back area (lower section) and the thigh area (lower section) of a person lying on the air mattress; three alternating inflation/deflation air supply/release systems system 1, system 2, and system 3—for supplying air to each of independent systems of specific bladder-shaped cells out of the air cell groups 10 for the shoulder area, back area (upper section), buttock area (upper section), thigh area (upper section), and knee area; and one air injection air supply system, for a total of eight air supply/release systems. It is thereby possible to individually adjust the air pressure within the bladder-shaped cells according to the part of the body, thus dispersing body pressure. In the present embodiment, the pressure within air cell groups 10*a*, log corresponding to the head area and heel area of the person lying on the air mattress is maintained at a fixed level, and the pressure within air cell groups 10*c*, 10*e* corresponding to the back area and the thigh area is set to be greater than that of air cell group 10*d* corresponding to the buttock area. In the present embodiment, the pressure within the air cell groups 10*a*, 10*g* corresponding to the head area and heel area of the person is maintained at a constant level; but a configuration in which the pressure within the air cell group 10*g* for the heel area is controlled so as to cause repeated inflation and deflation is possible. It is thereby possible to switch the part supporting the heel area between the thigh and the heel at a fixed interval, preventing repelling force from the mattress being placed upon the heel of the person for long periods of time. each of the bladder-shaped cells 17 is provided with a pressure sensor for measuring internal pressure, and the value measured by the pressure sensor can be output to a hand switch described below or the control circuit of the bed. In this case, a pressure sensor may be provided for all of the bladder-shaped cells 17, or a shared pressure sensor may be set for one air supply/release system.

As shown in FIG. 2, out of the bladder-shaped cells 17 of the plurality of air cell groups 10, the bladder-shaped cells 17 of air cell group 10*g*, which is disposed in correspondence to the heel area of a person lying on the air mattress, are shorter than the bladder-shaped cells 17 of the other air cell groups (10*a* through 10*f*), and the bladder-shaped cells 17 of the other air cell groups 10 extend to the edge of the air mattress. Thus, there is a space left between the bladder-shaped cells 17 of air cell group 10*g*, which corresponds to the heel area, and the edge of the air mattress. The bladder-shaped cells log disposed in correspondence to the heel area of the person lying on the air mattress are, for example, up to 30% shorter than the bladder-shaped cells 17 of the other air cell groups 10*a* through 10*f*. In other words, in the collection of bladder-shaped cells 17 in which a plurality of bladder-shaped cells is arranged and formed so as to describe a rectangle as a whole when seen in a plan view, out of the four corners thereof, there is a space in one of the corners by the heel area of the person lying on the air mattress in which bladder-shaped cells 17 are not disposed.

An air supply/release pump 11 is disposed within the space in which bladder-shaped cells 17 are not disposed so that the lengthwise direction thereof is, for example, perpendicular to the lengthwise direction of each of the bladder-shaped cells 17; i.e., so that the lengthwise direction is oriented in the direction from the head area to the heel area of the person lying on the air mattress. The air supply/release pump 11 is thereby disposed in a corner out of the four corners of the air mattress 1, which is configured so as to describe a rectangle as a whole when seen in a plan view, that corresponds to the heel area of the person lying on the air mattress. The part corresponding to the side of the heel area is a part that the body of the user of the air mattress does not readily contact even if the user turns over while sleeping, so that sleeping comfort is not reduced. It is also possible to cover the exterior surface of the air supply/release pump 11 with a flexible member of, for example, urethane so that, even when the heel of the person on the air mattress is positioned over the air supply/release pump 11 due to the person rolling over or the like, the flexible member acts as a cushion, thereby preventing a reduction in comfort. It is also possible to protect the air supply/release pump 11 from shocks from the heel using the flexible member. The flexible member used is preferably a member with high body pressure dispersibility. This also enables the risk of decubitus ulcer occurrence to be reduced. Because the air supply/release pump 11 is disposed at a part corresponding to the heel area of the air mattress user, the comfort of the mattress user is not negatively affected by the operating noise of the pump. Furthermore, by disposing the air supply/release pump 11 in an area within the range of the width and length of the air mattress made from the plurality of air cell groups 10, there is no need to dispose the pump 11 externally with respect to the air mattress, and ease of handling is obtained. The height of the air supply/release pump 11 is, for example, equal to or less than that of the bladder-shaped cells 17 of each of the air cell groups 10, creating a configuration in which it is possible to prevent the air supply/release pump 11, which is harder than each of the air-filled bladder-shaped cells 17, from jutting out beyond the air cell groups 10 in the height direction, as well as to prevent the position of the person lying on the air mattress from being higher than that of the side rails when the air mattress is placed on a bed having, for example, side rails.

In the present embodiment, as shown in FIG. 3, the plurality of air cell groups 10 and the air supply/release pump 11 are covered by a single top cover 14 of, for example, nylon fibers coated with polyurethane, and the upper surfaces thereof are protected. Because the upper surfaces of the air cell groups 10 and the air supply/release pump 11 are covered by the top cover 14, the lower surface of the air supply/release pump 11 is exposed to the exterior at one side surface in the widthwise direction of the air mattress 1 and a side surface corresponding to the heel area of the air mattress user in the lengthwise direction of the air mattress 1. When a top cover is provided, as in the case of the present embodiment, the collection of air cell groups formed by the plurality of air cell groups 10 and/or the air supply/release pump 11 is provided with a structure so that the top cover 14 can be fixed thereto, and the air supply/release pump 11 is fixed, for example, to the air cell groups 10.

As shown in FIG. 3, the air supply/release pump 11 is provided on, for example, a side exposed to the exterior on an end of the air mattress 1 in the lengthwise direction with one each of a power input cord, a cord connected to the mattress control circuit 15 for sending and receiving signals with the mattress control circuit 15, and a cord for sending and receiving signals with the hand switch 16 are provided. The hand switch 16 is provided with a switch for switching between various pressures of the air mattress, such as a decubitus ulcer prevention mode in which the amount of air supplied to and released from the bladder-shaped cells 17 connected to the air tubes 13 of, for example, air supply systems system 1, system 2, and system 3 is continuously varied so as to alternatingly inflate and deflate adjacent cells from the shoulder area to the knee area of the person lying on the air mattress, thus preventing a fixed amount of pressure from being placed on a part of the body of the mattress user. The air supply/release pump 11 is driven by power inputted from a power source, and is configured so as to send and receive signals with the mattress control circuit 15 on the basis of directions inputted from the hand switch 16, thereby altering, for example, the rate of rotation of a fan provided within the pump 11, controlling the amount of air supplied to and released from the air tubes 13 of the above seven air supply/release systems and one air injection system, and controlling the internal pressure of the bladder-shaped cells 17 connected to the air tubes 13 of each of the air supply systems.

Figure 7A:
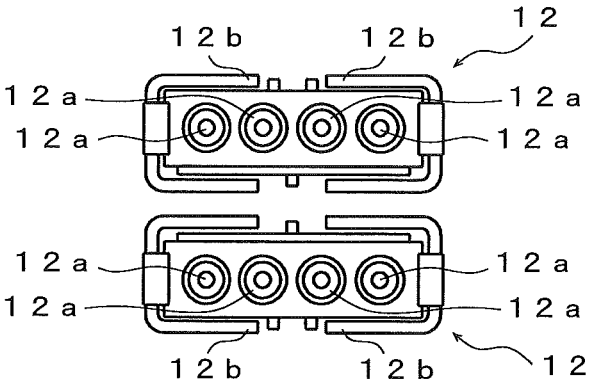
FIGS. 7(*a*) and 7(*b*) are views of an air tube-side connector of an air mattress according to an embodiment of the present invention from a mating surface side thereof.
Figure 7B:
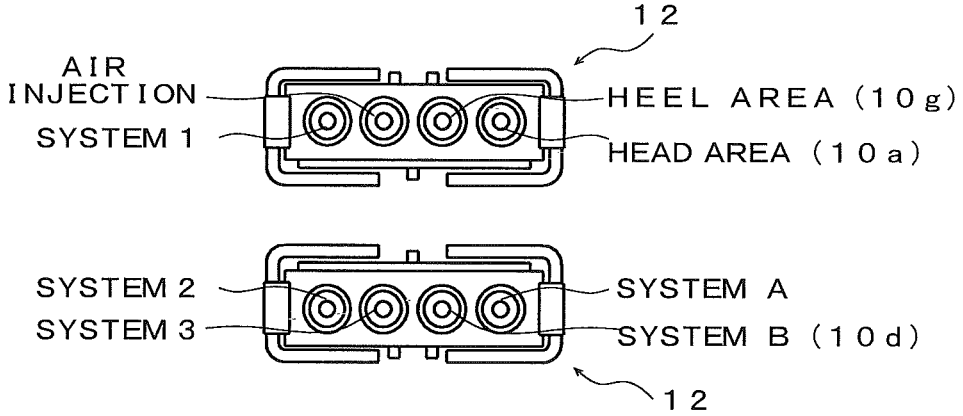

In the present embodiment, as shown in FIG. 5, the air tubes 13 are connected to the air supply/release pump 11 by a connector 12. An air supply/release pump-side connector 110 is provided in two locations on, for example, a side of the air supply/release pump 11 in the lengthwise direction opposite to that of the power cord. In the present embodiment, each of the air supply/release pump-side connectors 110 is provided with four air supply/release mouths 110*a*; and of the total of eight air supply/release mouths 110*a* provided on the air supply/release pump 11, seven are configured as air supply/release mouths for supplying and releasing air to and from the bladder-shaped cells connected to the head area, heel area, system 1 through 3, and system A and B via the air tubes 13. The remaining one of the eight air supply/release mouths 110*a* is configured as an air supply mouth, and it is possible to expel air from the plurality of injection holes provided on the outer surface of the air injection tube by supplying air to the air injection tube provided on the lower surface of the mattress, thus enabling moisture to be removed from the mattress. In the present embodiment, as shown in FIG. 6, an air tube-side connector 12 can connect four air tubes 13; thus, by connecting two air tube-side connectors 12 to the air supply/release pump 11 as shown in FIG. 5, the pressure within each of the bladder-shaped cells is controlled by the seven air supply/release systems via the air tubes 13 for each of the systems, and moisture is removed from the mattress by the one air injection system. FIG. 7(*b*) illustrates an example of an arrangement of air intake/release terminals 12*a* corresponding to the eight air supply/release systems.

As shown in FIG. 5, each of the two air supply/release pump-side connectors 110 is provided with four air supply/release mouths 110*a*; and by inserting the air intake/release terminals 12*a* of the air tube-side connectors 12 shown in FIG. 6 into the air supply/release mouths 110*a* and engaging a projection on a side of a connector cover 12*b* with an indentation on interior surfaces of the air supply/release pump-side connectors 110, the air tube-side connectors 12 are mated with the air supply/release-pump-side connectors 110. Rubber seals 12*c* are provided on exterior surfaces of the air intake/release terminals 12*a* of the air tube-side connectors 12, increasing the strength of the seal between the air supply/release mouths 110*a* and the air intake/release terminals 12*a*.

Figure 8A:
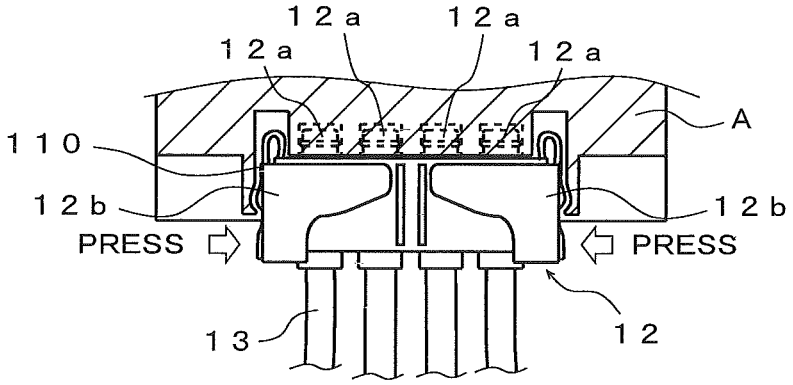
FIGS. 8(*a*) through 8(*c*) are partial plan views illustrating a process of removing a connector of an air mattress according to an embodiment of the present invention.
Figure 8B:
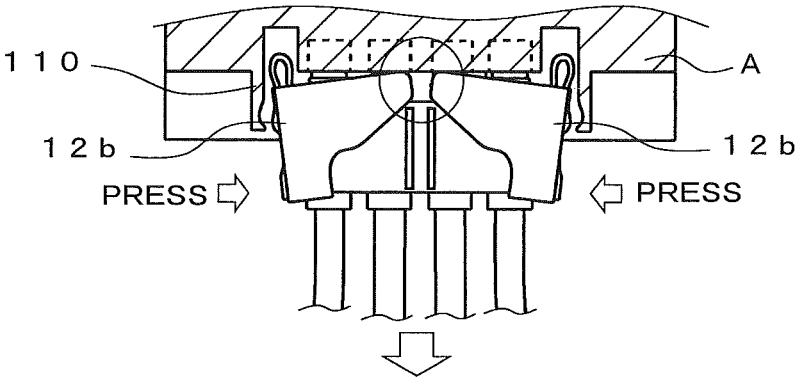
Figure 8C:
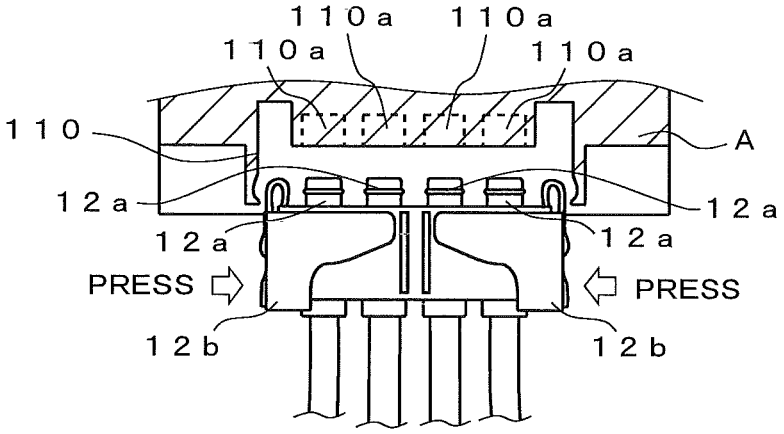

The present embodiment is configured so that, when the connectors 12 are removed from the air supply/release pump 11 as shown in FIGS. 8(*a*), 8(*b*), and 8(*c*), the connections between all of the air tubes 13 and each of the eight air supply/release systems are released, thus releasing control of the pressure within the bladder-shaped cells 17, and the air within all of the bladder-shaped cells is rapidly released through the air tubes 13 of each of the air supply/release systems.

As shown in FIG. 8(*a*) and FIG. 8(*b*), the connector 12 of the present embodiment is configured so that front ends of the connector covers 12*b* project in directions facing towards each other; and when rear ends of the connector covers 12*b* are pressed in directions approaching each other, the projecting tips of the connector covers 12*b* press upon the surface upon which the air supply/release mouths of the air supply/release pump-side connectors 110 are provided (the mating surface), as shown in FIG. 8(*b*), at the same time that the projections on the sides of the connector covers 12*b* and the indentations on the inner surface of the air supply/release pump-side connector 110 disengage.

Next, the operation of the air mattress according to the present embodiment will be described. In the present embodiment, when, for example, a switch of the hand switch 16 is operated, an input signal from the hand switch 16 is first inputted to the mattress control circuit 15 via the cord on the end of the air supply/release pump. The mattress control circuit 15 then controls, for example, the rate of rotation of the fan within the air supply/release pump 11 on the basis of the received signal. The amount of air supplied and released to and from the air tubes 13 connected to each of the air supply/release systems of the air supply/release pump is thereby controlled, in turn controlling the pressure within the bladder-shaped cells 17 connected to the air tubes 13 of each of the air supply systems.

At this time, the mattress control circuit 15 controls the pressure within the bladder-shaped cells corresponding to each of the air tubes 13 connected, for example, to the four block control air supply systems so that the pressure is constantly at a fixed amount. In other words, when the body weight of the person lying on the air mattress is, for example, from 30 to 135 kg, each of the air cell groups is separately controlled so that the pressure within the bladder-shaped cells of air cell group 10*a*, which corresponds to the person's head area, is for example from 1.6 to 4.3 kPa; the pressure within the bladder-shaped cells of air cell group 10*g*, which corresponds to the person's heel area, is for example from 1.1 to 3.0 kPa; the pressure within the bladder-shaped cells of the lower sections of air cell group 10*c* and 10*e* (system A), which correspond to the person's back area and thigh area, is for example from 1.5 to 6.4 kPa; and the pressure within the bladder-shaped cells of the lower section of air cell group 10*d* (system B), which corresponds to the person's buttock area, is for example from 1.1 to 3.3 kPa. By controlling the pressure within the bladder-shaped cells of the air cell groups 10*a*, 10*g* corresponding to the head area and the heel area of the person lying on the air mattress so that the pressure is a fixed amount, it is possible to stably support the locations corresponding to bones protruding outward from the back area of the body of the mattress user (the occipital bone and calcaneal bone) when the user is in a reclined state. By controlling the pressure within the bladder-shaped cells of the lower sections of air cell group 10*c* and 10*e* (system A), which correspond to the back area and thigh area of the person, so as to be greater than the pressure within the bladder-shaped cells of the lower section of air cell group 10*d* (system B), which corresponds to the buttock area, it is possible to stably support the buttock area, which protrudes toward the mattress and thus receives a larger load of the body's weight compared to other locations when the user is in a reclined state, from both sides, i.e., using the bladder-shaped cells of air cell group 10*c* and 10*e*, which correspond to the back area and the thigh area; this in turn enables the promotion of body pressure dispersion and the prevention of the repelling force placed by the air mattress on the buttock area of the person on the air mattress from becoming too great and decubitus ulcers from occurring. In cases where the air cell group 10*g* corresponding to the heel area is configured so as to repeatedly inflate and deflate, it is possible to stably support the location corresponding to the occipital bone of the person using the head area air cell group 10*a* in which the pressure is maintained at a constant level, reduce the repelling force placed by the air mattress on the buttock area by supporting the buttock area from both sides thereof using the back area and thigh area air cell groups 10*c*, 10*e*, and switch the part supporting the heel area between the thigh and the heel at a fixed interval using the repeatedly inflating and deflating heel area air cell group, preventing repelling force from being placed by the mattress on the heel of the person for long periods of time.

Meanwhile, for example, with regards to the air tube 13 of the three alternating inflation/deflation air intake/release systems, the mattress control circuit 15 first sets the amount of air supplied to the air tube 13 of the air intake/release system of system 1 to an amount smaller than the amount supplied to the air tubes 13 of the air intake/release systems of system 2 and system 3, and sets the amount of air being supplied to the air tubes 13 of system 2 and system 3 to roughly equal levels. The pressure within the bladder-shaped cells 17 connected to the air tubes of system 1 thereby becomes the smallest, and the pressure within the bladder-shaped cells 17 connected to the air tubes of system 2 becomes roughly equal to the pressure within the bladder-shaped cells 17 connected to the air tubes of system 3 and greater than the pressure within the bladder-shaped cells of system 1. At this time, in cases where a pressure sensor is provided in the bladder-shaped cells 17 of each of the systems, the mattress control circuit 15 increases or reduces the amount of air supplied to each of the systems on the basis of the values measured by the pressure sensors as appropriate, allowing the internal pressure within the bladder-shaped cells 17 connected to each of the systems to be rapidly set to a predetermined set value.

After maintaining the internal pressure of the bladder-shaped cells 17 connected to the air tubes 13 of each of the three alternating inflation/deflation systems in this state for a predetermined period of, for example, 460 seconds or less, the mattress control circuit 15 controls the amount of air supplied or released by the seven air supply/release systems, thereby increasing the pressure within the bladder-shaped cells of system 1, decreasing the pressure within the bladder-shaped cells of system 2, and maintaining the pressure within the bladder-shaped cells of system 3 at a fixed level. During a pressure transition period of, for example, 170 seconds or less, the pressure within the bladder-shaped cells 17 of system 2 thereby becomes the smallest, and the pressure within the bladder-shaped cells of system 1 and the pressure within the bladder-shaped cells of system 3 become roughly equal to each other and greater than the pressure within the bladder-shaped cells of system 2. The pressure within the bladder-shaped cells corresponding to the head area, back area (lower section), buttock area (lower section), thigh area (lower section), and heel area are maintained at a fixed level. In cases where the air cell group 10*g* for the heel area is configured so as to repeatedly inflate and deflate, air is supplied, for example, for sixty seconds to the bladder-shaped cells corresponding to the heel area when the cells are in, for example, a deflated state (in which the internal pressure is, for example, approximately 0.5 kPa) so as to inflate the bladder-shaped cells (to an internal pressure of, for example from 1.1 to 3.0 kPa). Then, with the bladder-shaped cells corresponding to the heel area in an inflated-state, after maintaining the internal pressure, for example, for 800 seconds, the air within the cells is released, for example, for ten seconds, deflating the bladder-shaped cells. Then, with the bladder-shaped cells corresponding to the heel area in a deflated state, the internal pressure is maintained, for example, for 870 seconds, and air is once again supplied to the interior of the cells.

In this state, the mattress control circuit 15 controls the internal pressure of each of the bladder-shaped cells 17 according to a method similar to that described above. In other words, the mattress control circuit 15 controls the pressure within each of the bladder-shaped cells by controlling amount of air being supplied or released by the seven air supply/release systems after a predetermined period of, for example, 460 seconds or less so that, during a pressure transition period of 170 seconds or less, the pressure within the bladder-shaped cells of system 3 becomes the smallest, and the pressure within the bladder-shaped cells of system 1 and the pressure within the bladder-shaped cells of system 2 become roughly equal to each other and greater than the pressure within the bladder-shaped cells of system 3. The pressure within the bladder-shaped cells corresponding to the head area, back area (lower section), buttock area (lower section), thigh area (lower section), and heel area are maintained at a fixed level. Internal pressure control as described above can also be performed in cases where the air cell group 10*g* corresponding to the heel area is configured so as to repeatedly inflate and deflate.

By controlling the pressure within the bladder-shaped cells connected to the air tubes 13 of each of the air supply/release systems, it is possible to vary over time the pressure within the bladder-shaped cells of the air cell groups 10 corresponding to the soft parts where the skin contacts the surface of the mattress, i.e., the shoulder area, back area, buttock area, thigh area, and knee area of a person when the person is in a reclined state, thereby preventing the same amount of pressure from being placed on specific parts of the skin for long periods of time, and thus decubitus ulcers from occurring.

When performing medical or caretaking work upon a person on the air mattress, a caretaker or the like can, for example, stop the decubitus ulcer prevention function of the air mattress by operating the hand switch 16. In other words, after the pressure within the bladder-shaped cells connected to the air tubes 13 of each of the systems has been set to a pressure suitable for medical or caretaking work or the like, the pressure is either maintained at the set pressure, or the pressure within all of the bladder-shaped cells 17 is set to the same level and maintained at the set pressure.

In the air mattress 1 according to the present embodiment, the air supply/release pump 11 is internal to the mattress, so that the air supply/release pump does not get in the way, improving the ease of performing medical or caretaking work and reducing the amount of space in which the air supply/release pump 11 is provided.

When it becomes necessary to perform emergency medical treatment, such as cardiopulmonary resuscitation, upon a person on the air mattress, the elasticity of the air mattress may impede medical treatment. When this happens, the air tubes 13 are detached from the air supply/release pump. In the air mattress 1 according to the present embodiment, the air tubes 13 are connected to the air supply/release pump 11 by the connector 12. As shown in FIG. 8(*a*) through FIG. 8(*c*), the connector 12 of the present embodiment is configured so that when rear ends of the connector covers 12*b* are pressed in directions approaching each other, the projecting tips of the connector covers 12*b* press upon the surface upon which the air supply/release mouths of the air supply/release pump-side connectors 110 are provided (the mating surface), as shown in FIG. 8(*b*), at the same time that the projections on the sides of the connector covers 12*b* and the indentations on the inner surface of the air supply/release pump-side connector 110 disengage. Thus, a caretaker or the like can quickly remove the connector 12 from the air supply/release pump 11 simply by pressing the sides of the connector 12, thereby enabling smooth release of air from all the bladder-shaped cells 17.

When the air mattress 1 is set, for example, upon a bed, and there is a need to move the person on the air mattress along with the bed, after, for example, a transport mode switch provided on the hand switch is pressed, a plug at the tip of the power cord of the air supply/release pump 11 is removed from a power supply course such as, for example, an electrical socket. The air supply/release pump 11 is configured so that, by pushing the transport mode button on the hand switch, the air release ports are closed so that air is not released from, for example, each of the air supply/release systems, and the pressure within each of the bladder-shaped cells is maintained at a fixed level. Large depressions due to depressurization of the bladder-shaped cells when the mattress user is being transported are prevented, and thus the occurrence of decubitus ulcers due to the buttock area of the mattress user being compressed by the frame of the bed is prevented.

In the air mattress 1 according to the present embodiment, because the air supply/release pump 11 is disposed at a corner of the mattress, it is easy to contact the air supply/release pump 11 when performing maintenance upon the air supply/release pump 11 and the air tubes 13 when the air mattress is not in use. In this case, when the air tubes 13 are detached from the air supply/release pump 11, if the air supply/release pump 11 is configured so as to be removable from the mattress, maintenance of the air supply/release pump 11 and the air tubes 13 becomes even easier.

In the present embodiment, as described above, the mattress control circuit 15 performs a control so as to maintain the pressure within the air cell groups 10 corresponding to the head area and heel area of a person lying on the air mattress 1 at a fixed level, and to set the pressure within the air cell groups 10*c*, 10*e* corresponding to the back area and thigh area to a level greater than the pressure within the air cell group 10*d* corresponding to the buttock area. It is thereby possible to stably support the buttock area of the person on the mattress from both sides by means of the air cell groups 10*c*, 10*e* corresponding to the back area and thigh area with the person being stably supported by the air cell groups 10*c*, 10*e* corresponding to the head area and heel area, and to disperse body pressure. It is thus possible to prevent the repelling force placed upon the buttock area of the person on the air mattress by the air mattress from growing large and decubitus ulcers from occurring. In cases where the air cell group log corresponding to the heel area is configured so as to repeatedly inflate and deflate, it is possible to stably support the location corresponding to the occipital bone of the person using the head area air cell group 10*a* in which the pressure is maintained at a constant level, reduce the repelling force placed by the air mattress on the buttock area by supporting the buttock area from both sides thereof by means of the back area and thigh area air cell groups 10*c*, 10*e*, and switch the part supporting the heel area between the thigh and the heel at a fixed interval using the repeatedly inflating and deflating heel area air cell group, preventing repelling force from being placed by the mattress on the heel of the person for long periods of time.

It is also possible to vary over time the pressure within the bladder-shaped cells of the air cell groups 10 corresponding to the soft parts where the skin contacts the surface of the mattress, i.e., the shoulder area, back area, buttock area, thigh area, and knee area of a person when the person is in a reclined state, thereby preventing the same amount of pressure from being placed on specific parts of the skin for long periods of time, and thus decubitus ulcers from occurring.

In the present embodiment, the effects of the present invention can also be obtained even when the alternating inflation/deflation function is operated because control is performed so that the pressure within the air cell groups for the back area and the thigh area is set to a higher level than the pressure within the air cell groups for the buttock area. An air mattress having an alternating inflation/deflation function was described for the present embodiment, but the air mattress of the present invention need not have an alternating inflation/deflation function. Specifically, the present embodiment is configured, as shown in FIG. 4, so that the bladder-shaped cells 17 of air cell groups 10*c* through 10*e* corresponding to the back area, buttock area, and thigh area are divided into upper section air cells 17*b* (and air chambers 17*a*) and lower section air cells 17*c*, the supply and release of air to and from the upper section air cells 17*b* (and air chambers 17*a*) is performed via one of the three alternating inflation/deflation systems 1 through 3, and the supply and release of air to and from the lower section air cells 17*c* is performed in independent systems for each of the air cell groups via block control system A or system B; however, a configuration in which the divisions between the upper section air cells and the lower section air cells of the bladder-shaped cells in air cell groups 10*c* through 10*e* corresponding to the back area, buttock area, and thigh area are partially removed, the upper section air cells and lower section air cells are connected so as to constitute single bladder-shaped cells 17, and air supply/release is performed in independent systems for each of the air cell groups is also possible. In such a case as well, it is possible to maintain the pressure within at least air cell groups 10*a*, log corresponding to the head area and heel area of the person lying on the mattress fixed at a predetermined pressure level, and to set the pressure within air cell groups 10*c*, 10*e* corresponding to the back area and thigh area at a level higher than the pressure within air cell group 10*d* corresponding to the buttock area, thereby stably supporting the buttock area of the person from both sides thereof using air cell groups 10*c*, 10*e* corresponding to the back area and thigh area and dispersing body pressure. When the pressure within air cell groups 10*a*, log corresponding to the head area and heel area are maintained at a fixed level, it is possible to disperse body pressure with the person on the air mattress being stably supported by the air cell groups 10*a*, log corresponding to the head area and heel area; and when a configuration in which air cell group log corresponding to the heel area is repeatedly inflated and deflated is adopted, it is possible to switch the part supporting the heel area between the thigh and the heel at a fixed interval, preventing repelling force from being placed by the mattress on the heel of the person for long periods of time.

Figure 9:
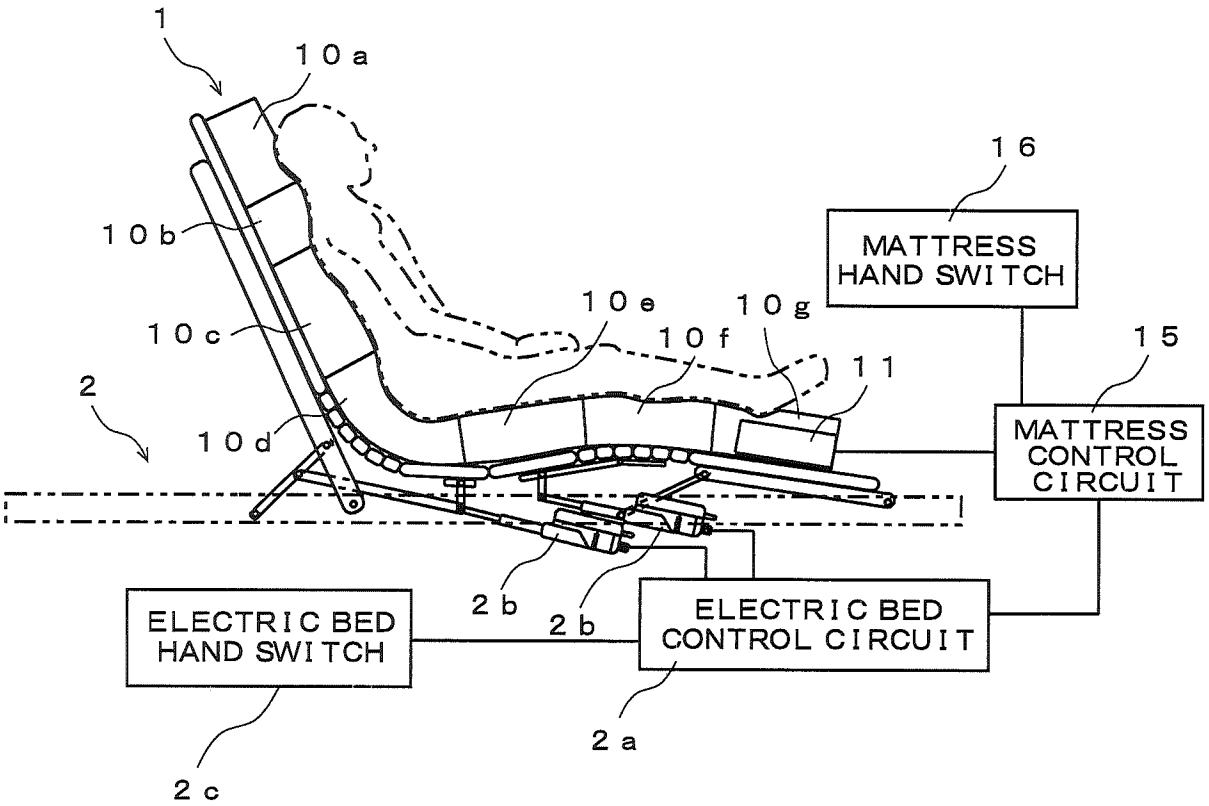
FIG. 9 is a schematic view of an air mattress according to a second embodiment of the present invention laid upon a back frame of an electric bed.

Next, an air mattress according to a second embodiment of the present invention will be described. As shown in FIG. 9, an air mattress 1 according to a second embodiment is laid upon a frame of a bed 2 having a raisable back frame and used. The bed 2 according to the present embodiment is an electric bed, and is configured so that a piston rod on the tip of an actuator 2*b* is made to advance or retract on the basis on input from a hand switch 2*c*, thereby raising or lowering the back in connection with various linkage mechanisms of the bed coupled to the tip of the piston rod.

In the present embodiment, the mattress control circuit 15 is connected to the control circuit 2*a* of the electric bed 2, and the back raising angle of the back frame is input as a signal via, for example, the control circuit 2*a* of the electric bed. It is configured to then control, for example, the rate of rotation of the fan for each of the air supply/release systems of the air supply/release pump 11 according to the back raising angle on the basis of the back raising angle signal so that, for example, a predetermined pressure value is obtained, thus controlling the pressure within each of the bladder-shaped cells connected to the eight air supply/release systems. The rest of the configuration is identical to that of the first embodiment.

Next, the operation of the air mattress according to the present embodiment will be described. In the present embodiment, when the bed hand switch 2*c* of the electric bed 2 is operated, a command from the bed hand switch is first inputted to the control circuit 2*a* of the electric bed 2. The electric bed control circuit 2*a* then decides the distance to advance or retract the piston rod on the tip of the actuator 2*b* according to the signal from the bed hand switch, thereby deciding the back raising angle of the back frame. Next, the electric bed control circuit 2*a* sends the signal regarding the back raising angle of the back frame to the mattress control circuit 15. The mattress control circuit 15 thereby decides the optimal pressure for each of the bladder-shaped cells connected to each of the air supply/release systems according to the inputted back raising angle signal. At this time, the mattress control circuit 15 controls the internal pressure of each of the bladder-shaped cells 17 connected to each of the air supply/release systems so that the pressure in air cell groups 10*c*, 10*e*, corresponding to the back area and thigh area, is higher than the pressure within air cell group 10*d*, corresponding to the buttock area, and furthermore so that the pressure within the air cell group 10*d* corresponding to the buttock area increases as the angle to which the back frame is raised increases.

Next, the electric bed control circuit 2*a* operates the actuator 2*b* by, for example, supplying power to the actuator 2*b*. The mattress control circuit 15 also controls, for example, the rate of rotation of the fans of the air supply/release pump 11 corresponding to each of the air supply/release systems, thereby controlling the air supply/release amount for each of the air supply/release systems so that the pressure within the bladder-shaped cells connected to each of the air supply/release systems becomes a predetermined pressure. The internal pressure of the bladder-shaped cells corresponding to each of the air supply/release systems is thereby set to an optimal value when the back frame of the electric bed 2 has been raised or lowered so as to reach a predetermined back raising angle. The value set for the internal pressure of the bladder-shaped cells is a pressure such that the body weight of the person on the air mattress is dispersed evenly over the mattress, and, for example, large localized pressure is not placed upon the mattress user and the mattress user does not feel as though there is a foreign object present or experience other types of discomfort; and is set to a value experienced in experiments or the like. In the present embodiment as well, as in the case of the first embodiment, the mattress control circuit 15 performs a control so that the internal pressure of the bladder-shaped cells in air cell groups 10*a*, 10*g* corresponding to the head area and heel area of the person lying on the air mattress is fixed. Alternatively, the mattress control circuit 15 controls the internal pressure of the bladder-shaped cells of air cell group 10*g* corresponding to the heel area so that the bladder-shaped cells repeatedly inflate and deflate. A control is also performed so that the internal pressure of the bladder-shaped cells in air cell groups 10*c*, 10*e* (system A) corresponding to the back area and thigh area of the person is greater than the internal pressure of the bladder-shaped cells in air cell group 10*d* (system B) corresponding to the buttock area. The pressure within air cell groups 10*c*, 10*e* corresponding to the back area and thigh area is also controlled so that the pressure within each of the air cells increases as the angle to which the back frame is raised increases.

In the present embodiment, the mattress control circuit 15 performs a control so that the pressure in the air cell groups supporting the back area and thigh area of the person lying on the air mattress 1 (air cell groups 10*c* and 10*e*, respectively) increases when the back frame of the bed is in a raised state. It is thereby possible to stably support the buttock area of the person on the air mattress from both sides thereof using the air cell groups supporting the back area and thigh area of the person even when the back frame of the bed has been raised, obtaining the effects of the present invention. It is also possible to prevent a large localized pressure from being placed upon the air mattress 1 corresponding to the buttock area of the person and mattress compression, in which that part of the air mattress 1 corresponding to the buttock area of the person is compressed and greatly caves in, from occurring even when the back frame of the bed is raised, as well as to stably support the mattress user.

In the present embodiment, because it is not the pressure in the air cell group 10*d* supporting the buttock area of the person lying on the air mattress 1, but rather the pressure in the air cell groups (10*c* and 10*e*, respectively) supporting the back area and thigh area on both sides of the buttock area, that is increased when the back frame is raised, it is possible to effectively distribute body pressure using the air mattress without the repelling force from the air mattress placed upon the buttock area of the area increasing and comfort being reduced.

Furthermore, in the present embodiment, because the mattress control circuit 15 controls the pressure of each of the air cell groups so that the pressure within the air cell group 10*d* corresponding to the buttock area increases as the angle to which the back frame is raised increases, it is possible to obtain the effects described above regardless of the back raising angle.

It is also possible in the present embodiment to obtain an air mattress configured so that the pressure within each of the bladder-shaped cells is continuously altered when the back frame of the bed 2 is raised.

It is also possible to obtain the effects described above regardless of the body weight of the person lying on the air mattress by configuring the air mattress of the present embodiment as described below. Specifically, a configuration is adopted in which body weight can be inputted into the hand switch 16, and control is performed so that the mattress control circuit 15 increases the pressure within each of the air cell groups the greater the body weight of the person. By configuring the air mattress in this way, it is possible to prevent mattress cave-in at, for example, a position corresponding to the buttock area from being larger, for example, in the case of a person with a high body weight than in the case of a person with a low body weight.

Figure 10:
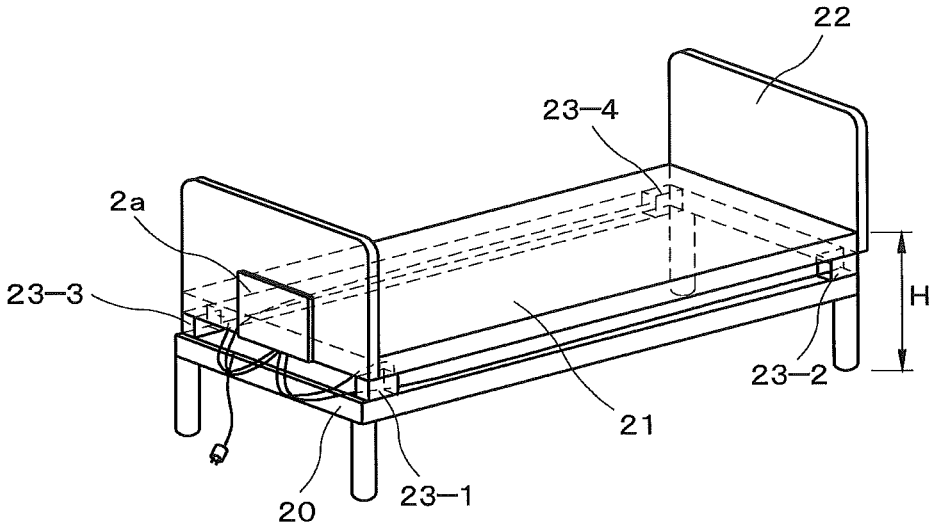
FIG. 10 is a schematic view of a bed having a load sensor.

In this case, as shown for example in FIG. 10, a configuration may also be adopted in which a load sensor 23 is provided at each of the four corners of the bed 2 upon which the air mattress 1 is laid, the body weight of the person on the air mattress is detected by these load sensors 23-1 through 23-4, and the body weight of the person on the mattress as detected by the load sensors 23 is inputted to the mattress control circuit 15 via the control circuit 2*a* of the electric bed.

INDUSTRIAL APPLICABILITY

The present invention is an air mattress capable of stably supporting the buttock area of a person from both sides thereof and of dispersing body pressure, thereby preventing the repelling force placed by the air mattress upon the buttock area of the person on the air mattress from growing large and decubitus ulcers from occurring, and is thus useful in preventing decubitus ulcers.

KEY

1 air mattress
10 air cell group
11 air supply/release pump
110 connector (air supply/release pump side)
110*a* air supply/release mouths
12 connector (air tube side)
12*a* air supply/release terminal
12*b* connector cover
12*c* rubber seal
13 air tube
14 top cover
15 mattress control circuit
16 hand switch
2 electric bed
2*a* electric bed control circuit
2*b* actuator
2*c* electric bed hand switch
23 load sensor

The invention claimed is:

1. An air mattress, comprising:

a plurality of air cell groups including a plurality of air cells and lined up with respect to a lengthwise direction of the air mattress so as to support at least a shoulder area, a back area, a buttock area, a thigh area, and a knee area of a person lying on said air mattress;

an air supply/release pump;

an air tube connecting said air cells and said air supply/release pump in one or a plurality of independent first systems for each of certain air cell groups out of said air cell groups and one or a plurality of independent second systems for each of specific air cells out of a remainder of certain air cell groups out of the plurality of air cell groups; and a controller for controlling air supply/release by the air supply/release pump to said first systems and second systems, wherein each of the air cell groups corresponding to said back area, buttock area, and thigh area includes a lower section of air cells and an upper section of air cells, wherein the lower section air cells are connected to said first system via said air tube, and wherein each of the air cells in each of the air cell groups corresponding to said shoulder area, knee area, as well as the upper section of the back area, buttock area, and thigh area, are connected to one system out of the plurality of said second systems via said air tube.

2. The air mattress according to claim 1, wherein said controller performs a control so that pressure in the air cell groups corresponding to the head area and heel area of the person lying on said air mattress is maintained at a fixed level.

3. The air mattress according to claim 1, wherein said controller controls pressure so that the pressure in the air cell groups corresponding to the head area of the person lying on said air mattress is maintained at a fixed level, and the air cell groups corresponding to the heel area are repeatedly inflated and deflated.

4. The air mattress according to claim 1, wherein the air cells of said air cell groups are rod-shaped and bladder-shaped cells extending in the widthwise direction of the air mattress, and the air cells are configured so as to be lined up in the lengthwise direction of the air mattress.

5. An air mattress, comprising:

a plurality of air cell groups including a plurality of air cells and lined up with respect to the lengthwise direction of the air mattress so as to support at least a shoulder area, a back area, a buttock area, a thigh area, and a knee area of a person lying on said air mattress;

an air supply/release pump;

an air tube connecting said air cells and said air supply/release pump in a plurality of independent systems for each of the air cell groups; and a controller for controlling air supply/release by said air supply/release pump to said plurality of systems, wherein each of the air cell groups corresponding to said back area, said buttock area, and said thigh area includes a lower section of air cells and an upper section of air cells which are independent to each other and are controlled independently, wherein the lower section air cells are connected to a system of the plurality of independent systems via said air tube, and wherein each of the air cells in each of the air cell groups corresponding to said shoulder area and said knee area, and said each of the upper sections of the air cells in each of the air cell groups corresponding to said back area, said buttock area, and said thigh area is connected to another system of the plurality of independent systems via said air tube.

6. The air mattress according to claim 5, wherein said controller performs a control so that a pressure in the air cell groups corresponding to the head area and heel area of the person lying on said air mattress is maintained at a fixed level.

7. The air mattress according to claim 5, wherein said controller controls pressure so that the pressure in the air cell groups corresponding to the head area of the person lying on said air mattress is maintained at a fixed level, and the air cell groups corresponding to the heel area are repeatedly inflated and deflated.

8. The air mattress according to claim 6, wherein the air cells of said air cell groups comprise rod-shaped and bladder-shaped cells extending in a widthwise direction of the air mattress, and the air cells are configured so as to be lined up in the lengthwise direction of the air mattress.

9. An air mattress, comprising:

a plurality of air cell groups including a plurality of air cells and lined up with respect to the lengthwise direction of the air mattress so as to support at least a shoulder area, a back area, a buttock area, a thigh area, and a knee area of a person lying on said air mattress;

an air supply/release pump;

an air tube connecting said air cells and said air supply/release pump in one or a plurality of independent first systems for each of certain air cell groups out of said air cell groups and one or a plurality of independent second systems for each of specific air cells out of a remainder of certain air cell groups out of the plurality of air cell groups; and a controller for controlling air supply/release by the air supply/release pump to said first systems and second systems, wherein each of the air cell groups corresponding to said back area, buttock area, and thigh area includes a lower section of air cells and an upper section of air cells, wherein the lower section air cells are connected to said first system via said air tube, and wherein each of the air cells in each of the air cell groups corresponding to said shoulder area and knee area, and each of the upper section air cells in each of the back area, buttock area, and thigh area, are connected to one system out of the plurality of said second systems via said air tube.

* * * * *